US011253421B2

(12) United States Patent
Wüst

(10) Patent No.: US 11,253,421 B2
(45) Date of Patent: Feb. 22, 2022

(54) MASSAGE DEVICE

(71) Applicant: Dirk Wüst, Schopfheim (DE)

(72) Inventor: Dirk Wüst, Schopfheim (DE)

( * ) Notice: Subject to any disclaimer, the term of this patent is extended or adjusted under 35 U.S.C. 154(b) by 0 days.

(21) Appl. No.: 17/250,694

(22) PCT Filed: Aug. 24, 2018

(86) PCT No.: PCT/EP2018/072881

§ 371 (c)(1),
(2) Date: Feb. 19, 2021

(87) PCT Pub. No.: WO2020/038586

PCT Pub. Date: Feb. 27, 2020

(65) Prior Publication Data

US 2021/0212884 A1 Jul. 15, 2021

(51) Int. Cl.
*A61H 15/00* (2006.01)

(52) U.S. Cl.
CPC ..... *A61H 15/00* (2013.01); *A61H 2015/0064* (2013.01); *A61H 2015/0071* (2013.01); *A61H 2201/1454* (2013.01); *A61H 2201/1673* (2013.01)

(58) Field of Classification Search
CPC ..... A61H 15/00; A61H 2201/1454; A61H 2201/1673; A61H 2015/0071; A61H 2015/0064; A61H 23/00; A61H 15/0092; A61H 15/02; A61H 2015/005; A61H 2201/1207; A61H 2201/1253
See application file for complete search history.

(56) References Cited

U.S. PATENT DOCUMENTS 4,433,683 A 2/1984 McCoy et al.
4,796,616 A * 1/1989 Panahpour ..... A61H 15/00 601/128
5,492,526 A 2/1996 Chen
5,545,456 A 8/1996 Suida
5,628,772 A 5/1997 Russell
(Continued)

FOREIGN PATENT DOCUMENTS

DE 39002329 T2 11/1993
DE 29906372 U1 7/1999
(Continued)

OTHER PUBLICATIONS

International Patent Application No. PCT/EP2018/072881, International Search Report with English Translation dated Apr. 23, 2019, 13 pages.

*Primary Examiner* — Quang D Thanh
(74) *Attorney, Agent, or Firm* — Leber IP Law; Celia H. Leber

(57) ABSTRACT

A massage device, including at least two massage elements and at least one bearing element, which is arranged between the massage elements, wherein the bearing element is designed in such a way that the massage elements can rotate independently with at least two rotational degrees of freedom per massage element, wherein the massage elements are surrounded by a tensioning element, which substantially defines the spatial position of the massage elements, wherein the bearing element includes bearing balls, which are arranged circularly, and wherein the bearing balls are arranged in a bearing cage.

17 Claims, 3 Drawing Sheets

(56) References Cited

U.S. PATENT DOCUMENTS

| | | | | | |
|---|---|---|---|---|---|
| 5,787,541 | A * | 8/1998 | Chen | A47K 7/022 | 15/209.1 |
| 6,007,501 | A * | 12/1999 | Cabados | A61H 39/04 | 601/131 |
| 6,174,297 | B1 * | 1/2001 | Chen | A47K 7/02 | 15/209.1 |
| 2009/0069729 | A1 * | 3/2009 | Burns | A63B 21/00043 | 601/134 |
| 2012/0309593 | A1 | 12/2012 | Smith | | |
| 2013/0085426 | A1 | 4/2013 | Brodsky | | |
| 2016/0022531 | A1 * | 1/2016 | Ryan | A61H 15/0092 | 601/131 |

FOREIGN PATENT DOCUMENTS

| | | | |
|---|---|---|---|
| FR | 1169036 | A | 12/1958 |
| FR | 1171617 | A | 1/1959 |
| JP | 2004174193 | A | 6/2004 |
| WO | 2016085748 | A1 | 6/2016 |

* cited by examiner

MASSAGE DEVICE

RELATED APPLICATIONS

This application is a national phase entry of International Patent Application No. PCT/EP2018/072881, filed Aug. 24, 2018, the entire disclosure of which is incorporated herein by reference.

BACKGROUND

The invention relates to a massage device according to the preamble of the independent patent claim.

In the state of the art, massage devices with many different shapes are known, e.g. as massage balls, massage rollers and the like. Also specially designed devices are known, in which a plurality of massage elements, such as two balls, are coupled to one another by a rigid connection.

Given the versatile application possibilities, such massage devices enjoy great popularity.

However, particularly in case of devices in which a plurality of massage elements are coupled to one another, the problem arises in the prior art that the individual massage elements cannot or can only be moved to a limited extent relative to one another, which severely limits their usability. For example, if two massage balls are rigidly coupled via a connecting part, each massage element of the massage device has only one effective rotational degree of freedom, so that an effective rolling movement over the body regions to be treated is only possible in one direction.

Thus, it is an object of the present invention to create a massage device having a plurality of massage elements which allows a more flexible application and which in particular allows a massage movement in a plurality of directions.

SUMMARY

Thus, the invention relates to a massage device which comprises at least two massage elements and at least one bearing element arranged between the massage elements. In particular, such a massage device may also be referred to as fascia roller.

According to the invention, it is provided that the bearing element is designed in such a way that the massage elements can be rotated independently with at least two rotational degrees of freedom per massage element. According to the invention, the at least two massage elements are thus not rigidly connected, but are arranged so as to be movable, in particular rotatable, relative to one another. According to the invention, it is provided that each massage element is not only rotatable about one single axis, but about a plurality of rotational axes, preferably any number of rotational axes, wherein the rotatability of one massage element is preferably independent of further massage elements. The massage elements are preferably arranged at a fixed or substantially fixed distance to one another.

Preferably, the device according to the invention is designed in such a way that at least two massage elements can freely rotate in all spatial directions. "Independent rotatability" means in particular that the massage elements are not connected to one another via rigid axles. Optionally, it may in particular be provided that the massage elements do not touch each other directly.

This allows the massage device to roll in any direction, i.e. in particular in one plane. In particular, this enables two-dimensional rolling. Thus, a more targeted massage effect can be achieved.

Sometimes, adhesions, hardenings, trigger points, etc. may be more extensive, in which case a one-dimensional movement is not sufficient to cover all the areas one wants to reach. For example, using the device according to the invention, circular massage movements are possible, which may promote efficient relaxation.

In the context of the present invention, the term "rotational degree of freedom" may refer to an independent rotational possibility of a geometric object/element, in particular a massage element. According to this definition, for example, a ball has three independent rotational degrees of freedom. If two balls are connected to one another via a connecting axle, each of the two balls has only one independent rotational degree of freedom.

Since the rotation of the individual massage elements is possible with at least two rotational degrees of freedom each, there are at least two orthogonal axes of rotation about which each massage element can rotate independently of the respective other massage element. According to the invention, it may be provided that each massage element is rotatable independently of the movement of the respective other massage element(s).

Optionally, it may be provided that at least one, preferably all, massage elements have a spherical design. The spherical design of the massage elements relates to a preferred embodiment of the invention, since this ensures a particularly flexible applicability of the device according to the invention. However, the massage elements may optionally have different geometric shapes that allow them to rotate; they may, e.g., be spheroids. Optionally, the massage elements may also have projections or similar means that may enhance the massage effect.

Optionally, the massage elements may have diameters between 30 mm and 250 mm. Preferably, the massage elements have diameters between 80 mm and 150 mm.

If the massage elements are not spherical, the diameter refers to the greatest possible distance between two points located on the outer surface of the respective massage element.

Optionally, the massage elements may be made of or comprise plastic, preferably expanded polystyrene or expanded polypropylene (EPP). The plastic can have different hardness and/or elasticity properties depending on the field of application.

Optionally, it may be provided that the bearing element comprises bearing balls, which are arranged in a circle. The circular arrangement of bearing balls may allow the massage elements to be mounted particularly simply relative to one another. Optionally, between 6 and 14, preferably between 8 and 12, bearing balls may be provided. The bearing balls may have diameters between 5 mm and 30 mm, preferably between 10 mm and 20 mm. Optionally, the bearing balls of a bearing element may have the same or different diameters.

Optionally, a bearing element may have a diameter between 50 mm and 100 mm, preferably between 60 mm and 90 mm. Optionally, the diameter of a bearing element may be between 50% and 80% of the diameter of those massage elements between which the respective bearing element is arranged. If the two massage elements have different diameters, the mean diameter of the two massage elements is used as the decisive diameter.

For the purposes of the present invention, the diameter of the bearing element is understood as the respectively largest outer diameter of a circular or annular bearing element, i.e. the largest possible distance between two points on the outer surface of the bearing element.

Optionally, it may be provided that the bearing balls have a mounting hole along their diameter. It may be provided that the bearing balls are arranged on an annular connecting element, which is guided in the mounting holes.

Optionally, it may be provided that the bearing balls are arranged in a bearing cage. The bearing cage serves to fix the spatial arrangement of the bearing balls. The bearing cage can have receiving openings adapted to the geometry of the bearing balls. The receiving openings are preferably designed in such a way that the bearing balls can be held in the receiving openings and do not fall out of them. The bearing cage can be designed as one piece or more pieces.

Optionally, it may be provided that the massage elements and/or the bearing balls are made of or comprise wood, metal, cork, bamboo, and/or of plastic, in particular hard plastic, styrofoam, rubber. However, the massage elements and/or the bearing balls can in principle be made of any suitable material.

Optionally, it may be provided that the massage elements, in particular the arrangement of massage elements and bearing element(s), are surrounded by a tensioning element. The tensioning element can serve in particular to fix the spatial position of the massage elements relative to one another. The tensioning element can thus substantially define the distance between the massage elements. The tensioning element can be provided to exert a tensioning force on the massage elements, which directs them towards each other. This allows the massage elements to be pressed against at least one bearing element. Preferably, the tensioning element is configured as a stocking-shaped piece of fabric, which surrounds the arrangement of bearing element(s) and massage elements.

Optionally, the tensioning element may be made of elastic material, in particular elastic fabric material. Preferably, the elastic material is made of plastic fibers.

For example, the plastic fibers may comprise polyamide fibers and spandex fibers, wherein between 80 wt. % and 98 wt. % of polyamide fibers and between 2 wt. % and 20 wt. % of spandex fibers may be provided. Optionally, the elastic material may comprise or be made of softshell fabric, anti-slip fabric, PVC material, natural fiber (for example, cotton or linen), Cordura® (particularly robust and abrasion-resistant polyamide fabric), thermoplastic polyurethane, microfiber with and without various coatings, and the like.

Optionally, the tensioning element may comprise a woven material.

Optionally, the elastic material of the tensioning element may comprise or be made of bouclé. Bouclé may be a woven fabric or a fabric having a coarse, nubby surface, which is produced by processing irregular, knotty yarns or fibers. Such a bouclé fabric may optionally made of or comprise synthetic and/or natural fibers.

Optionally, the elastic material of the tensioning element may be a double-face fabric. Such materials or fabrics have two sides that are tightly woven together. Optionally, the double-face fabric may comprise a nub-like outer skin on the side facing outwards and a robust and well-sliding fabric, in particular a smooth fabric, on the side facing inwards.

Optionally, it may be provided that the tensioning element is made of a plurality of layers. This can increase the mechanical durability of the tensioning element.

Optionally, it may be provided that the massage elements are magnetically coupled via at least one magnetic bearing element, so that the spatial position of the massage elements and their distance are substantially defined. In this embodiment, the use of a tensioning element may not be necessary. Holding the arrangement of massage element and bearing element together may optionally be accomplished by arranging magnetic elements in the bearing element and massage elements.

A magnetic element may be or include a ferromagnetic material, such as iron, or a permanent magnet.

Optionally, a tensioning device may be provided, which is designed to substantially define the spatial position and the distance of the massage elements to one other. In particular, the tensioning device may be configured as a tensioning element or as magnetic elements in the bearing element and massage elements.

Optionally, it may be provided that the tensioning device is designed in such a way that it exerts a tensioning force on the massage elements. Optionally, the tensioning force can act in the direction of the bearing element, which is arranged between two massage elements. Optionally, the tensioning force can act in the direction of the geometric center of gravity of the massage device.

Optionally, it may be provided that at least one massage element comprises a vibration unit, for example an electric motor. The vibration unit, in particular the electric motor, can be designed in such a way that it causes the least one massage element to vibrate. In this way, a particularly efficient massage effect can be achieved.

Optionally, it may be provided that at least one massage element comprises a heat storage unit. Such a heat storage unit can be used to store heat or cold and keep the massage elements at a higher or lower temperature compared to the ambient temperature for a longer period of time. For example, gels, gel bags, metal bodies or the like may be used as heat storage unit. Optionally, it may be provided that the heat storage unit is arranged in a massage element. Optionally, the heat storage unit may be removable from the massage element. The heat storage unit may be heated or cooled by common methods, such as by an oven, microwave, refrigerator, chemical reaction, and the like. Thus, the massage device according to the invention can be used together with temperature stimuli.

Optionally, it may be provided that the massage elements comprise structural elements, at least in part. Such structural elements may, for example, be or comprise nubs, protrusions, protruding hemispheres, and the like. The structural elements may be a part of the massage elements, i.e. in particular made of the same material as the massage elements. The structural elements may be made of a different material than the massage elements and may be connected to the massage elements, in particular to the surface of the massage elements, for example by gluing or welding. Optionally, the structural elements can be arranged on the massage elements by means of a coating. Optionally, the structural elements can be made of foamed PVC, silicone gel or nubby soft plastic. This can improve the blood supply to the area to be treated, which can promote the therapeutic effect.

Optionally, it may be provided that the bearing element comprises or consists of a holding device. The holding device can at least partially surround the massage elements, in particular in a cage-like manner. The holding device can be designed in such a way that the massage elements can freely rotate in all spatial directions.

Optionally, it may be provided that the holding device is designed as an arrangement of at least two holding cages, wherein each holding cage is designed to receive a massage element so that each massage element is arranged freely movably, in particular freely rotatably, within the holding cage, and wherein each holding cage is connected to at least one further holding cage. Within the holding cages, the massage elements can rotate freely. Optionally, the arrangement of bearing cages, i.e. the holding device, can act as a bearing element.

Optionally, it may be provided that a holding cage comprises two holding rings, which are substantially arranged in parallel and preferably connected to one another by connecting struts.

Preferably, the diameter of the holding rings is smaller than the diameter of the massage element. Preferably, one holding ring is arranged above and one holding ring below a diameter plane of the massage element. In particular, both holding rings can be arranged in parallel to one another and in parallel to the diameter plane. If the holding rings are connected to one another via connecting struts or other suitable connectors, the massage element is positioned in the holding cage but can freely rotate within the holding cage.

Optionally, the holding rings may be positioned at a distance of about 10 mm to about 20 mm from a diameter plane of the massage element.

Optionally, a holding cage may be made of metal, plastic or other suitable materials.

Optionally, it may be provided that bearing balls are arranged on the at least two holding cages, in particular on the holding rings. This can further improve the rotatability of the massage elements. The bearing balls can be made of wood, plastic, metal and other suitable materials. Optionally, the bearing balls may have a mounting hole, through which the holding ring is passed. Optionally, between 15 and 30 bearing balls may be arranged on one holding ring. The number of bearing balls is preferably adapted to their size and to the size of the massage element.

Optionally, it may be provided that two, three, four or six massage elements are provided. Optionally, it may be provided that a bearing element is arranged between individual massage elements.

According to a preferred embodiment, two massage elements, in particular two spherical massage elements, can be provided, between which a bearing element is arranged.

According to a further preferred embodiment, three massage elements, in particular three spherical massage elements, can be provided in a triangular arrangement, with one bearing element being provided between every two massage elements.

According to a further preferred embodiment, four massage elements, in particular four spherical massage elements, may be provided in a quadrangular, in particular square, arrangement, with one bearing element being provided between every two massage elements.

Further features according to the invention become apparent from the description of the exemplary embodiments, the figures, and the claims.

The invention will now be explained in detail by means of exemplary embodiments. The exemplary embodiments serve merely as illustrations and are not intended to limit the scope of protection.

DETAILED DESCRIPTION

Figure 1:
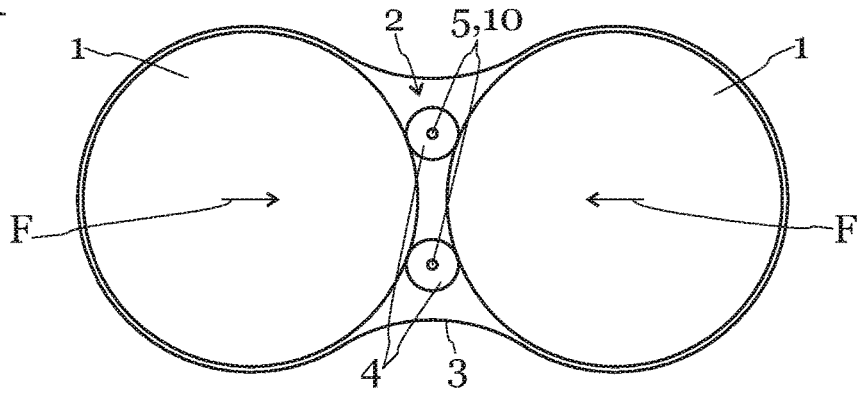
FIG. 1 shows a schematic sectional view of a first exemplary embodiment of the present invention.
Figure 2:
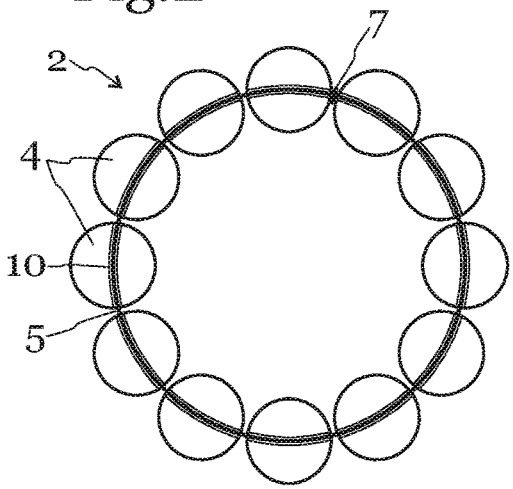
FIG. 2 shows a schematic sectional view of an embodiment of a bearing element according to the present invention.

FIG. 1 shows a schematic sectional view of a first exemplary embodiment of the present invention, wherein two massage elements 1 are provided, which are spherical and each have a diameter of approximately 120 mm. A bearing element 2 is arranged between the massage elements 1, which is designed as a circular bearing element 2, as shown in FIG. 2. Here, the bearing element 2 comprises bearing balls 4, which are arranged on a connecting element 5. The two massage elements 1 are surrounded by a single continuous tensioning element 3, which is designed as an elastic plastic fabric material. The tensioning element surrounds the arrangement of massage elements 1 and bearing element 2 in the manner of a stocking.

In this exemplary embodiment, the bearing element 2, which is shown in a schematic sectional view in FIG. 2, comprises twelve bearing balls 4, each of which has a mounting hole 10, which is arranged substantially along its diameter. A connecting element 5, which in this exemplary embodiment is designed as a steel wire, extends through the mounting hole of each bearing ball 4. In this exemplary embodiment, the connecting element 5 is made of a linear steel wire, which has locking elements 7 on both ends. The locking elements 7 are configured to engage each other to form an annular bearing element 2. In other exemplary embodiments, the connecting element 5 may also be welded or otherwise connected to form an annular structure.

In this exemplary embodiment, the annular bearing element 2 has an outer diameter of about 85 mm. Thus, the outer diameter of the bearing element 2 is approximately 70% of the outer diameter of the massage elements 1.

In other exemplary embodiments not shown, the connecting element 5 may be made of other materials, such as stainless steel, plastic, or other suitable materials. In other exemplary embodiments not shown, the connecting element 5 may be made of a structure having overlapping regions, thereby forming a closed annular structure, as is known, for example, from so-called key rings.

The outer diameter of the connecting element 5 is slightly smaller than the inner diameter of the mounting hole 10 of the bearing balls 4, in order to allow the bearing balls 4 to move freely. In this exemplary embodiment, the bearing balls 4 are made of wood. The bearing balls 4 have a diameter of about 20 mm.

The tensioning element 3, which in this exemplary embodiment is made of a multilayer plastic fabric material, exerts a tensioning force F on the massage elements 1, which directs them towards each other, thereby pressing the massage elements 1 against the bearing balls 4 of the bearing element 2. The diameter of the bearing element 2/the size of the bearing balls 4 is chosen so that the two massage elements 1 do not touch each other, i.e. do not have a common contact surface.

The free bearing of the massage elements 1 on the bearing element 2 allows a rotational movement of the massage elements 1 with three rotational degrees of freedom. Hence, there are three orthogonally aligned rotation axes, each running through the geometric center of the massage elements 1 and around which each massage element 1 can rotate independently of the respective other massage element 1. However, the individual massage elements 1 may also rotate synchronously, in which case the massage elements 1 may have common and/or different axes of rotation.

Figure 3A:
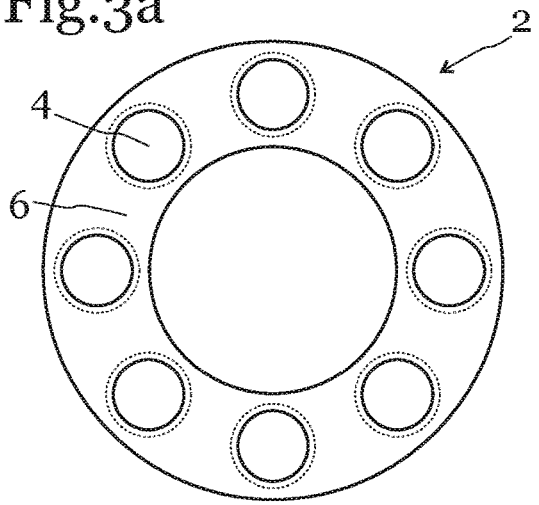
FIG. 3*a* shows a schematic sectional view of a further embodiment of a bearing element according to the present invention.

FIG. 3*a* shows a schematic sectional view of a further embodiment of a bearing element 4 according to the present invention, which can be used as an alternative to the bearing element 4 shown in FIG. 2. Here, an annular bearing cage 6 is provided, which is designed to fix the bearing balls 4. In this exemplary embodiment, the bearing cage 6 is made of stainless steel, the bearing balls 4 are made of plastic.

Figure 3B:
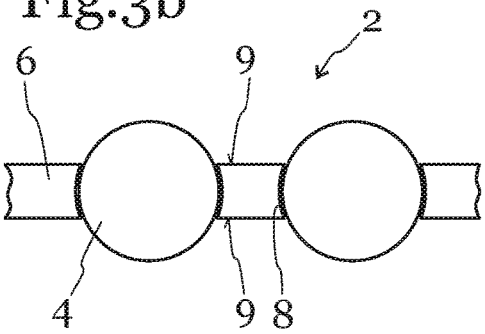
FIG. 3*b* shows a schematic detailed view of the embodiment of the bearing element shown in FIG. 3*a;*

FIG. 3*b* shows a schematic detailed view of the embodiment of a bearing element 2, in particular the bearing cage 6, as shown in FIG. 3*a* and described above. For mounting the bearing balls 4, which in this exemplary embodiment do not have mounting holes, receiving openings 8 are provided in the bearing cage 6. In this exemplary embodiment, the receiving openings 8 have arcuate sections, so that the width of the receiving openings 8 is smallest on the two surfaces 9 of the bearing cage 6. In this exemplary embodiment, the width of the receiving openings 8 in the region of the two surfaces 9 is smaller than the diameter of the bearing balls 4. If the bearing balls 4 are made of a slightly elastic plastic, they can be pressed into the receiving openings 8 during assembly of the bearing element 2 and remain in them when the bearing element 2 is used as intended. When the bearing balls 4 are in the receiving openings 8, free rotation in all directions is possible. In this exemplary embodiment, eight bearing balls are provided.

According to an exemplary embodiment not shown, the bearing cage 6 can also be of a multi-part design to accommodate the bearing balls 4. Then, the bearing cage can be formed, for example, from an upper part and a lower part, wherein the bearing balls 4 are arranged in receiving openings 8, which are formed jointly by the upper part and the lower part. The bearing cage 6 may be formed around the bearing balls 4, in which case the bearing balls 4 need not be flexible.

The bearing element 2 according to the embodiment shown in FIGS. 3*a* and 3*b* and described herein can be used analogously to the bearing element 2 shown in FIG. 2.

Figure 4:
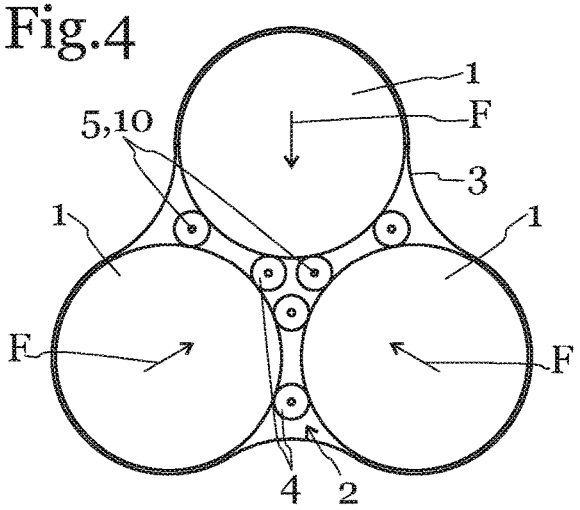
FIG. 4 shows a schematic sectional view of a second exemplary embodiment of the present invention.

FIG. 4 shows a schematic sectional view of a second exemplary embodiment of the present invention, wherein three massage elements 1 are provided in a triangular arrangement. The three massage elements 1 are rotatably mounted with respect to one another by means of one bearing element 2 each, wherein a total of three bearing elements 2 are provided. The arrangement of massage elements 1 and bearing elements 2 is connected by a single tensioning element 3, as already described in the first exemplary embodiment of FIG. 1. The tensioning element 3 is made of an elastic fabric material and surrounds the arrangement in a stocking-like manner. The tensioning force F generated by the tensioning element 3 pulls the massage elements 1 toward the center of the massage device. In this exemplary embodiment, the three bearing elements 2 are arranged independently of each other.

In other exemplary embodiments not shown, a plurality of bearing elements 2 may be connected to one another by means of a bearing connecting element 11. In another embodiment not shown, a central bearing ball may be arranged between three massage elements 1. In this case, the central bearing ball can preferably be in contact with the massage elements 1.

Figure 5:
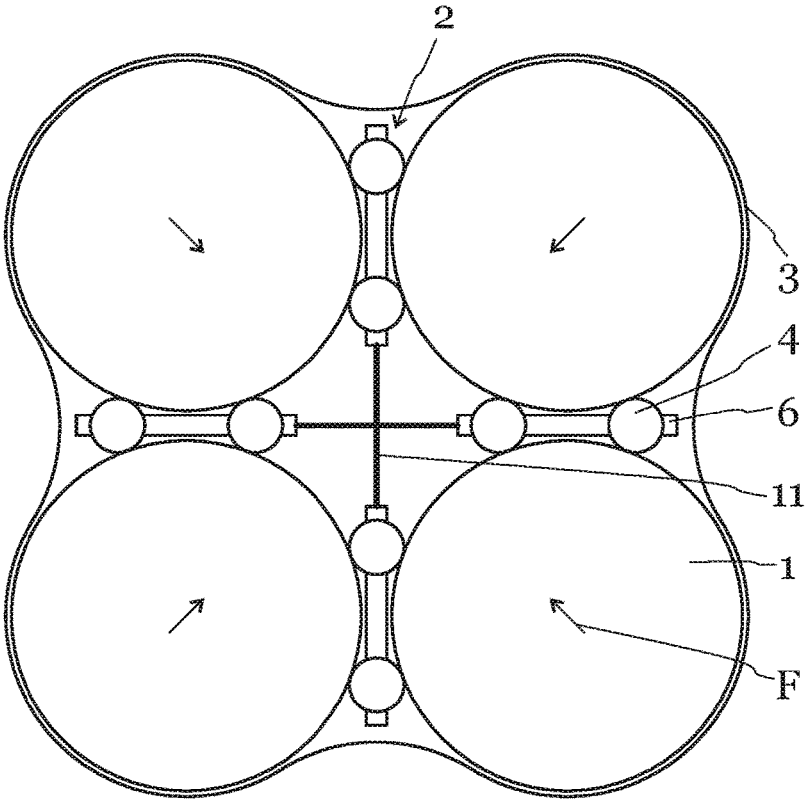
FIG. 5 shows a schematic sectional view of a third exemplary embodiment of the present invention.

FIG. 5 shows a schematic sectional view of a third exemplary embodiment of the present invention, wherein four massage elements 1 are provided in a square arrangement. Four bearing elements 2 are provided, which are designed according to the bearing element 2 shown in FIGS. 3*a* and 3*b*. Thus, bearing balls 4 are rotatably arranged in a bearing cage 6.

In the third exemplary embodiment, the bearing elements 2 are each arranged between two massage elements 1, the four bearing elements 2 being connected to one another in a cross shape by means of a bearing connecting element 11. Thus, the position of the bearing elements 2 relative to one another is fixed.

The entire arrangement of four bearing elements 2, bearing connecting element 11 and massage elements 1 is surrounded by a common tensioning element 3. The tensioning element 3 exerts a tensioning force F on the arrangement, which is directed towards the center of the arrangement of four bearing elements 2, bearing fixing element 11 and four massage elements 1. In particular, the bearing connecting element 11 connects the bearing cages 6.

In an embodiment not shown, a central bearing ball may be arranged between the bearing elements 2 instead of the bearing connecting element 11. In this case, the central bearing ball can preferably be in contact with the massage elements 1.

Figure 6A:
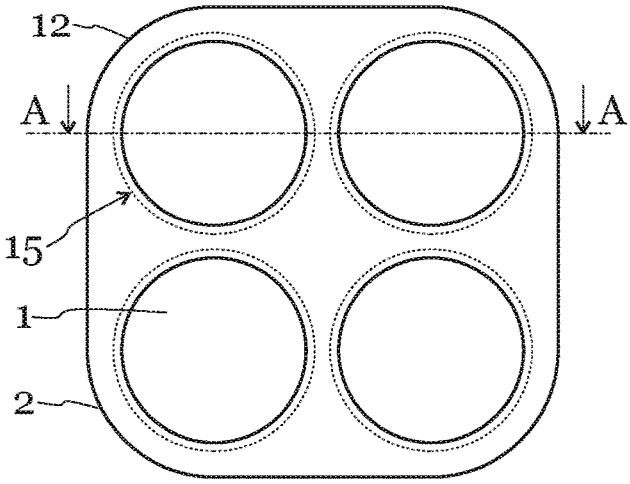
FIG. 6*a* shows a schematic sectional view of a fourth exemplary embodiment of the present invention.
Figure 6B:
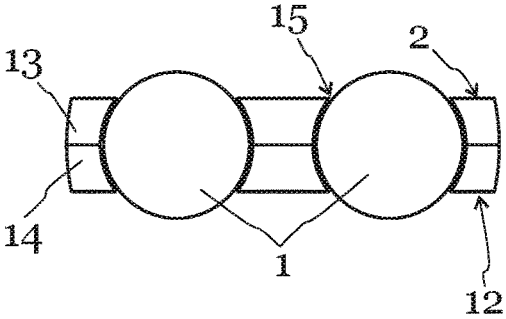
FIG. 6*b* shows a further schematic sectional view of the fourth exemplary embodiment of the present invention.

FIG. 6*a* shows a schematic sectional view of a fourth exemplary embodiment of the present invention, wherein four massage elements 1 are arranged to form a square. The spherical massage elements 1 are held in position by a holding device 12, the holding device 12 also serving as a bearing element 2. FIG. 6*b* shows the fourth embodiment of the invention in a sectional view along axis A-A. Here it can be seen that the holding device 12 comprises a first holding element 13 and a second holding element 14, wherein the first holding element 13 and the second holding element 14 surround the spherical massage elements 1 in a cage-like manner. The massage elements 1 are mounted in a freely rotatable manner within the holding device 12, but are fixedly positioned therein, as the diameter of the holding opening 15 at the top and bottom of the holding device 12 is smaller than the diameter of the massage elements 1.

In further embodiments not shown, two, three, five, six or more massage elements 1 may also be provided in an arrangement according to FIGS. 6*a* and 6*b*.

Figure 7A:
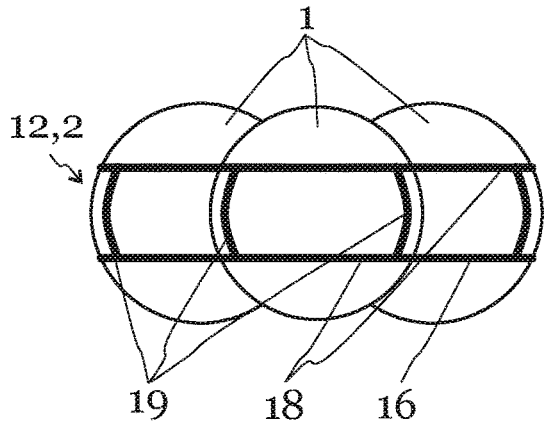
FIG. 7*a* shows a schematic top view of a fifth exemplary embodiment of the present invention.
Figure 7B:
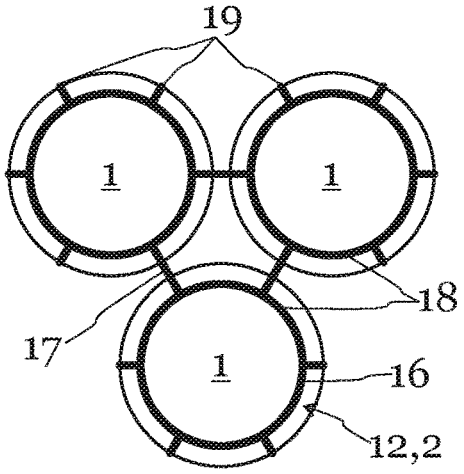
FIG. 7*b* shows a schematic lateral view of the fifth exemplary embodiment of the present invention.

FIG. 7*a* shows a schematic top view of a fifth exemplary embodiment of the present invention. FIG. 7*b* shows the same fifth exemplary embodiment in a schematic lateral view.

In this exemplary embodiment, three spherical massage elements 1 are provided, which are arranged to form a triangle. Each massage element 1 is surrounded by a holding cage 16, which, in this exemplary embodiment, is made of a rigid metal framework. In other exemplary embodiments not shown, the holding cage(s) 16 may be made of any other suitable material, such as plastic.

The holding cage(s) 16 are connected to one another at joints 17 to form a holding device 12 which forms a bearing element 2.

Each massage element 1 is arranged so as to be freely rotatable in the respective holding cage 16. This is achieved by each holding cage 16 comprising two holding rings 18, which surround the massage elements 1 in a circle. The two holding rings 18 are held together by connecting struts 19. The diameter of the holding rings 18 is smaller than the diameter of the massage elements 1, each holding ring 18 being arranged at a distance of about 15 mm from a diameter plane of the respective massage element 1. The connecting struts 19 each hold together two holding rings 18, thus forming the holding cage 16.

Figure 8A:
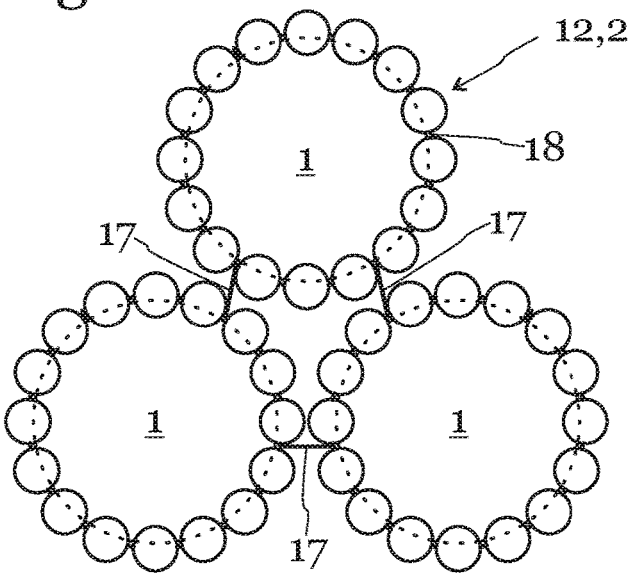
FIG. 8*a* shows a schematic top view of a sixth exemplary embodiment of the present invention.
Figure 8B:
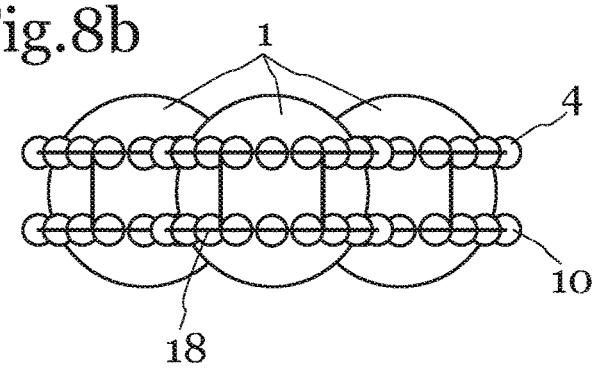
FIG. 8*b* shows a schematic lateral view of the sixth exemplary embodiment of the present invention.

FIG. 8*a* shows a schematic top view of a sixth exemplary embodiment of the present invention. FIG. 8*b* shows a schematic lateral view of the sixth exemplary embodiment of the present invention.

In this exemplary embodiment, three spherical massage elements 1 are provided, which are arranged to form a triangle. Each massage element 1 is surrounded by a holding cage 16, which, in this exemplary embodiment, is made of a rigid metal framework. In other exemplary embodiments not shown, the holding cage(s) 16 may be made of any other suitable material, such as plastic.

Each holding cage 16 comprises two holding rings 18, which are held together by connecting struts. One massage element 1 is arranged within each holding cage 16. On the holding rings 18, bearing balls 4 are arranged.

The bearing balls 4 have a mounting hole 10, through which the holding ring is passed. Preferably, the bearing balls 4 are in contact with the massage element 1 so that the massage element can rotate freely.

Each holding cage 16 is connected to two further holding cages 16 via joints 17.

LIST OF REFERENCE SIGNS

1 Massage element
2 Bearing element
3 Tensioning element
4 Bearing ball
5 Connecting element
6 Bearing cage
7 Locking element
8 Receiving opening
9 Surface
10 Mounting hole
11 Bearing connecting element
12 Holding device
13 First holding element
14 Second holding element
15 Holding opening
16 Holding cage
17 Joint
18 Holding ring
19 Connecting strut
F Tensioning force

The invention claimed is:

1. A massage device, comprising at least two massage elements and at least one bearing element disposed between the at least two massage elements, wherein the at least one bearing element is configured to allow the at least two massage elements to rotate independently with at least two rotational degrees of freedom per massage element, and wherein the at least two massage elements are surrounded by a tensioning element, which defines a spatial position of the massage elements, and wherein the at least one bearing element comprises bearing balls, which are arranged circularly, and the bearing balls are arranged in a bearing cage.

2. The massage device according to claim 1 wherein at least one of the at least two massage elements is spherical.

3. The massage device according to claim 2, wherein all of the at least two massage elements are spherical.

4. The massage device according to claim 2, wherein at least one of the at least two massage elements has a diameter between 30 mm and 250 mm.

5. The massage device according to claim 2, wherein at least one of the at least two massage elements has a diameter between 80 mm and 150 mm.

6. The massage device according to claim 1, wherein the at least two massage elements and/or the bearing balls comprise wood, metal, cork, bamboo and/or plastic.

7. The massage device according to claim 6, wherein the plastic is selected from the group consisting of hard plastic, extruded polystyrene foam or rubber.

8. The massage device according to claim 1, wherein the at least one bearing element comprises between 6 and 14 bearing balls.

9. The massage device according to claim 8, wherein the at least one bearing element comprises between 8 and 12 bearing balls.

10. The massage device according to claim 1, wherein the tensioning element is an elastic fabric material, which surrounds the at least two massage elements.

11. The massage device according to claim 10, wherein the elastic fabric material comprises plastic fibers.

12. The massage device according to claim 1, wherein the tensioning element is multi-layered.

13. The massage device according to claim 1, wherein the tensioning element is configured to exert a tensioning force (F) onto the at least two massage elements, which directs the at least two massage elements towards each other.

14. The massage device according to claim 1, wherein the at least two massage elements are magnetically coupled by the at least one bearing element so that the spatial position of the massage elements is defined.

15. The massage device according to claim 1, wherein at least one of the at least two massage elements comprises a vibration unit.

16. The massage device according to claim 1, wherein at least one of the at least two massage elements comprises a heat storage unit.

17. The massage device according to claim 1, wherein two, three, four or six massage elements are provided and in that a bearing element is arranged between individual massage elements.

* * * * *